US008197617B2

(12) United States Patent
Nakaya et al.

(10) Patent No.: US 8,197,617 B2
(45) **Date of Patent: *Jun. 12, 2012**

(54) HIGH-STRENGTH STEEL SHEET HAVING EXCELLENT ELONGATION, STRETCH FLANGEABILITY AND WELDABILITY

(75) Inventors: Michiharu Nakaya, Kakogawa (JP); Yoichi Mukai, Kakogawa (JP); Koichi Sugimoto, Nagano (JP)

(73) Assignee: Kobe Steel, Ltd., Kobe-shi (JP)

( * ) Notice: Subject to any disclaimer, the term of this patent is extended or adjusted under 35 U.S.C. 154(b) by 574 days.

This patent is subject to a terminal disclaimer.

(21) Appl. No.: 12/303,634

(22) PCT Filed: Jun. 4, 2007

(86) PCT No.: PCT/JP2007/061300

§ 371 (c)(1),
(2), (4) Date: Dec. 5, 2008

(87) PCT Pub. No.: WO2007/142196

PCT Pub. Date: Dec. 13, 2007

(65) Prior Publication Data

US 2010/0172786 A1 Jul. 8, 2010

(30) Foreign Application Priority Data

Jun. 5, 2006 (JP) ..... 2006-156441

(51) Int. Cl.
*C22C 38/04* (2006.01)
*C22C 38/06* (2006.01)
*C22C 38/22* (2006.01)

(52) U.S. Cl. ..... 148/654; 148/320

(58) Field of Classification Search ..... 148/320, 148/654; 420/84, 103, 104, 120
See application file for complete search history.

(56) References Cited

U.S. PATENT DOCUMENTS

| | | | |
|---|---|---|---|
| 6,280,538 | B1 | 8/2001 | Soshiroda et al. |
| 7,371,294 | B2 | 5/2008 | Miura et al. |
| 7,413,617 | B2 | 8/2008 | Ikeda et al. |
| 2005/0150580 | A1 | 7/2005 | Akamizu et al. |
| 2005/0161134 | A1 | 7/2005 | Ikeda et al. |
| 2005/0247378 | A1 | 11/2005 | Ikeda et al. |
| 2006/0137768 | A1 | 6/2006 | Yuse et al. |
| 2006/0137769 | A1 | 6/2006 | Yuse et al. |
| 2008/0251160 | A1 | 10/2008 | Akamizu et al. |
| 2008/0251161 | A1 | 10/2008 | Kashima et al. |
| 2009/0014095 | A1 | 1/2009 | Mukai et al. |

FOREIGN PATENT DOCUMENTS

| | | |
|---|---|---|
| JP | 2002 30933 | 1/2002 |
| JP | 2004 190050 | 7/2004 |
| JP | 2004 332099 | 11/2004 |
| JP | 2005 240178 | 9/2005 |
| JP | 2005 330584 | 12/2005 |

OTHER PUBLICATIONS

U.S. Appl. No. 12/303,566, filed Dec. 5, 2008, Nakaya, et al.
U.S. Appl. No. 12/305,998, filed Dec. 22, 2008, Saito, et al.
U.S. Appl. No. 11/908,616, filed Sep. 14, 2007, Miura, et al.
U.S. Appl. No. 12/159,400, filed Jun. 27, 2008, Kinugasa, et al.
Examination report issued Feb. 9, 2011 in the corresponding United Kingdom Patent Application No. GB0900058.9.
U.S. Appl. No. 12/671,453, filed Jan. 29, 2010, Nakaya, et al.
U.S. Appl. No. 12/477,299, filed Jun. 3, 2009, Ikeda, et al.
Sugimoto, K. et al. "Stretch-flangeability of a High-strength TRIP Type Bainitic Sheet Steel", ISIJ International, vol. 40, No. 9, pp. 920-926, (2000).
Office Action issued Feb. 21, 2011, in Korean Patent Application No. 9-5-2011-009716584 (with English Translation).
Second Office Action issued Dec. 19, 2011, in Chinese Patent Application No. CN200780020760, filed Jun. 4, 2007 (w/English-language Translation).

*Primary Examiner* — Jessica L Ward
*Assistant Examiner* — Alexander Polyansky
(74) *Attorney, Agent, or Firm* — Oblon, Spivak, McClelland, Maier & Neustadt, L.L.P.

(57) ABSTRACT

The present invention provides a high-strength steel sheet which has a 980 MPa class tensile strength as well as has excellent elongation, stretch flangeability and weldability, and also has excellent anti-delayed fraction property. The high-strength steel sheet comprises steel satisfying: C: 0.12 to 0.25%, Si: 1.0 to 3.0%, Mn: 1.5 to 3.0%, P: 0.15% or less, S: 0.02% or less, Al: 0.4% or less, and comprising the remnant made from iron and unavoidable impurities, wherein a ratio of the contents of Si and C (Si/C) is within the range from 7 to 14 in terms of a mass ratio, and a microstructure in a longitudinal section comprises, by an occupancy ratio based on the entire structure, 1) bainitic ferrite: 50% or more, 2) lath-type residual austenite: 3% or more, and 3) block-type residual austenite: 1% or more to ½×occupancy ratio of lath-type residual austenite, and 4) average size of block-type second phase is 10 μm or less.

13 Claims, No Drawings

HIGH-STRENGTH STEEL SHEET HAVING EXCELLENT ELONGATION, STRETCH FLANGEABILITY AND WELDABILITY

TECHNICAL FIELD

The present invention relates to a high-strength steel sheet which has a tensile strength of 980 MPa or higher class as well as has excellent elongation, stretch flangeability and spot-weldability, and also has excellent anti-delayed fraction property and is useful as automotive structural parts (body flame members such as pillar, member and reinforcement; bumper, door guard bar, sheet parts, suspension parts, and other reinforcing members).

BACKGROUND ART

In recent years, for the purpose of reducing fuel consumption due to saving body weight of automobiles and ensuring safety upon collision, demands for high-strength steels have increased more and more. Accordingly, steel sheets having a tensile strength of 980 MPa or higher class have been required in place of those having a tensile strength of 590 MPa class. Moreover, in the case of high-strength steel sheets having a tensile strength of 980 MPa or higher class, deterioration of formability cannot be avoided and there was restriction on applications since it is possible to apply to parts having complicated shapes. In applications where the steel sheet is press-formed into a complicated shape, it is required to provide a high-strength steel sheet having both elongation and stretch flangeability.

Now various steel sheets including residual austenite in the metal structure are put into practical use as high-strength steel sheets that exhibit excellent elongation.

For example, Non-Patent Document 1 discloses a steel sheet in which a bore expansion property (i.e. stretch flangeability) is enhanced while ensuring a high strength by constituting the metal structure with a composite structure which mainly contains bainitic ferrite and also contains lath-type residual austenite. However, when a tensile strength (TS) becomes a tensile strength of 980 MPa or higher class, this steel sheet shows TS×El as an indicator of the strength (TS) and ductility (El) of 9,000 to 10,300 at most and therefore it is hardly to say that the steel sheet is satisfactory.

It is considered that, in a mass production line of a practical operation using a continuous annealing furnace, a maximum heating temperature is about 900° C. and a heating time is 5 minutes or less. However, under the production conditions disclosed in this document, it is required to cool to a temperature within the range from 350 to 400° C. in a salt bath after annealing at 950° C. for 1,200 seconds, and thus this method is not suited for the practical operation.

In Patent Document 1, elongation of about 20% and stretch flangeability (λ) of 55% are attained while ensuring a tensile strength of 980 MPa or higher by constituting a matrix phase with a structure composed mainly of bainitic ferrite and 3% or more of residual austenite. However, in this technique, the addition of expensive alloy elements such as Mo, Ni and Cu is indispensable and it leaves a room for improvement in cost.

Furthermore, Patent Document 2 discloses steel sheets having enhanced total elongation and stretch flangeability by mainly constituting a matrix structure with tempered bainite. However, since a study is mainly made on steels having a 900 MPa class tensile strength in this steel type, delayed fracture, which is caused in steels having a tensile strength of 980 MPa or higher class, is not sufficiently studied.

Non-Patent Document 1: ISIJ International, Vol. 40 (2000), No. 9, pp. 920 to 926

Patent Document 1: Japanese Unexamined Patent Publication (Kokai) No. 2004-332099

Patent Document 2: Japanese Unexamined Patent Publication (Kokai) No. 2002-30933

DISCLOSURE OF THE INVENTION

Problems to be Solved by the Invention

The present invention has been made in view of the above-mentioned prior arts, and an object thereof is to provide a high-strength steel sheet which has a tensile strength of 980 MPa class suited for use as automotive structural parts and has excellent elongation (El) and stretch flangeability (λ), and also has excellent spot-weldability and excellent anti-delayed fraction property, without adding expensive alloy elements such as Mo, Ni and Cu.

Means for Solving the Problems

The high-strength steel sheet of the present invention, which could achieve the above object, is a high-strength steel sheet having excellent elongation, stretch flangeability and weldability, comprising a steel satisfying: C: 0.12 to 0.25%, Si: 1.0 to 3.0%, Mn: 1.5 to 3.0%, P: 0.15% or less (excluding 0%), S: 0.02% or less (excluding 0%), Al: 0.4% or less (excluding 0%), and comprising the remnant made from iron and unavoidable impurities, wherein a ratio of the contents of Si and C (Si/C) is within the range from 7 to 14 in terms of a mass ratio, and a microstructure in a longitudinal section comprises, by an occupancy ratio based on the entire structure, 1) bainitic ferrite: 50% or more, 2) lath-type residual austenite: 3% or more, and 3) block-type residual austenite: 1% or more to ½×occupancy ratio of lath-type residual austenite, and 4) average size of block-type second phase is 10 μm or less.

The steel sheet of the present invention may contain, as other elements, at least one kind selected from the group consisting of:

Ti: 0.15% or less (excluding 0%),

Nb: 0.1% or less (excluding 0%), and

Cr: 1.0% or less (excluding 0%), or may contain Ca: 30 ppm or less (excluding 0%) and/or REM: 30 ppm or less (excluding 0%).

It is particularly preferred that the high-strength steel sheet of the present invention has a tensile strength of 980 MPa or higher so as to more effectively make use of its high strength.

Effect of the Invention

According to the present invention, by specifying chemical components of the steel material as described above, particularly controlling a ratio Si/C within a specific range, and constituting the metal structure with a composite structure which mainly contains bainitic ferrite and also contains lath-type residual austenite and block-type residual austenite, it is possible to provide a steel sheet which has good elongation-stretch flangeability and excellent workability, and also has excellent spot-weldability and anti-delayed fraction property while ensuring a tensile strength of 980 MPa or higher class at cheap price.

DETAILED DESCRIPTION OF THE PREFERRED EMBODIMENTS

In light of the problems described above, the present inventors have focused on a TRIP steel sheet (Transformation Induced Plasticity) having a tensile strength of 980 MPa or higher class, comprising bainitic ferrite as a matrix phase, and intensively studied by paying attention to the form of the second phase in the metal structure and chemical components, especially C and Si so as further improve elongation and stretch flangeability. Thus, the following finings were obtained.

1) When the content of block-type residual austenite (hereinafter referred to as residual γ) is decreased and the content of lath-type residual γ is increases in the metal structure, anti-delayed fraction property is improved.

2) When a predetermined amount of fine block-type residual γ is incorporated, deterioration of stretch flangeability is suppressed and thus balance between the tensile strength (TS) and elongation (El) is enhanced.

3) When Si and C among chemical components of the steel are adjusted so as to obtain a mass ratio within a preferred range, it is possible to obtain a desired structure having a tensile strength of 980 MPa or higher class while suppressing deterioration of spot-weldability.

Based on these findings, the present inventors have intensively studied about an influence of the contents of Si and C in steel components on properties of residual γ contained in the metal structure, strength, elongation and stretch flangeability of the steel sheet, and spot-weldability and anti-delayed fracture characteristics. As a result, they have confirmed that a high-strength steel sheet having high performances, which achieve the above object, can be obtained by controlling the occupancy ratio of bainitic ferrite in the metal structure, controlling the occupancy ratios of lath-type residual γ and block-type residual γ and controlling the size of the block-type residual γ to a specific value using a steel material having specific component composition described above. Thus, the present invention has been completed.

Specific constitutions of the present invention will be made clear by way of reasons for decision of chemical components of the steel material.

First, reasons for decision of chemical components of the steel material are explained.

C: 0.10% or More and 0.25% or Less

C is an element which is indispensable so as to ensure a high strength and residual γ, and is an important element so as to incorporate a sufficient amount of C in a γ phase thereby retaining a desired amount of the γ phase at room temperature. In order to effectively exert such an effect, the content of C must be 0.10% or more, preferably 0.12% or more, and 0.15% or more. When the content of C is too large, a severe adverse influence is exerted on spot-weldability, and thus the upper limit was 0.25% in view of security of spot-weldability. The C content is preferably 0.23% or less, and more preferably 0.20% or less.

Si: 1.0 to 3.0%

Si is an essential element which effectively serves as a solution-hardening element and also suppresses formation of a carbide as a result of decomposition of residual γ. In order to effectively exert such an effect, the content of Si must be 1.0% or more, and preferably 1.2% or more. Since the effect is saturated at 3.0% and problems such as deterioration of spot-weldability and hot shortness arise when the content is more than the above value, the content may be suppressed to 3.0% or less, and preferably 2.5% or less.

Mn: 1.5 to 3.0%

Mn is an element required to suppress formation of excess polygonal ferrite thereby forming a structure composed mainly of bainitic ferrite. Also it is an important element required to stabilize γ thereby ensuring desired residual γ. The occupancy ratio of Mn is at least 1.5% or more, and preferably 2.0% or more.

However, since excess addition causes deterioration of spot-weldability and anti-delayed fraction property, the content is suppressed to 3.0% at most, and preferably 2.5% or less.

P: 0.15% or Less, S: 0.02% or Less

These elements are inevitably incorporated into the steel and cause deterioration of formability and spot-weldability when the content increases, and thus the content must be suppressed to the upper limit or less.

Al: 0.4% or Less

Al is a useful element so as to suppress formation of a carbide thereby ensuring residual γ similar to Si. However, if Al is too much, polygonal ferrite is likely to be produced; therefore, the content should be suppressed to 0.4% at most, and preferably 0.2% or less.

Si/C: 7 to 14 (Mass Ratio)

Although a predetermined amount of C is required so as to ensure residual γ in the metal structure, spot-weldability, especially a cross tensile strength decreases when the C content increases. Namely, when the content of the residual γ is increased so as to enhance workability utilizing the TRIP effect, deterioration of spot-weldability cannot be avoided and it was difficult to reconcile the workability and weldability. However, when the contents of C and Si are adjusted so as to obtain a Si/C of 7 or more, C can be more efficiently concentrated in the residual γ and thus deterioration of spot-weldability can be avoided.

In order to obtain the intended metal structure, it is necessary to promote a bainitic ferrite transformation by suppressing formation of polygonal ferrite as possible. Since Si has the effect of promoting the bainitic ferrite transformation, it become easy to obtain the target metal structure in the present invention by satisfactorily adjusting the Si content according to the C content.

When the ratio Si/C is less than 7, namely, the Si content is too small relative to the C content, the bainitic ferrite transformation does not easily proceed and the amount of coarse block-type residual γ easily increases. In this case, stability of the residual γ deteriorates and it becomes impossible to expect the effect exerted on elongation, and thus satisfactory stretch flangeability cannot be obtained.

Such an effect is saturated at the ratio Si/C of about 14. When the Si content excessively increases, it becomes easy to form polygonal ferrite and coarse block-type residual γ, and thus the effect of the present invention is adversely affected. From such a point of view, more preferred ratio Si/C is 8 or more and 12 or less.

Nb: 0.1% or Less, Ti: 0.15% or Less

Since these elements have the effect of enhancing toughness by refinement of the metal structure, these elements can be optionally added in a small amount. However, further effect is not obtained to cause cost-up even if they are added in the amount of more than the upper limit, therefore it is wasteful.

Cr: 1.0% or Less

Since Cr has the effect of suppressing formation of polygonal ferrite thereby enhancing the strength, it can be optionally added. However, when it is excessively added, an adverse influence may be exerted on formation of the target metal structure in the present invention. Therefore, the content should be suppressed to 1.0% at most.

Mo, Cu, Ni: Each about 0.1% or Less

These elements are effective for improving the strength and anti-delayed fraction property. In the present invention, excellent performances are sufficiently obtained without adding these elements and it is not necessary to add because these elements are expensive and cause cost-up. There is no restriction on the content in a level of impurities and these elements may be added in the amount of about 0.1% or less.

Next, reasons of limitation of the metal texture will be explained.

Bainitic Ferrite≧50%

Bainitic ferrite is an important structure since it has not only the effect of easily achieving a high strength because of somewhat high dislocation density, but also the effect of decreasing a difference in hardness between bainitic ferrite and residual γ as the second phase thereby enhancing stretch flangeability. In order to effectively exert these effects, the content of bainitic ferrite must be exist at 50% or more. The content is more preferably 60% or more.

In the present invention, the bainitic ferrite is clearly different from a bainite structure in that the structure does not include carbides, and is also different from a polygonal ferrite structure having a lower bainite structure which does not contain or contains little dislocation, or a quasi-polygonal ferrite structure having a lower bainite structure such as fine subgrain. These differences can be easily identified by TEM (Transmission Electron Microscope) observation.

Lath-Type Residual γ≧3%

"Lath-type form" as used herein means those in which an average axial ratio (ratio major axis/minor axis:aspect ratio) is 3 or more. Such a lath-type residual γ not only has the effect of the TRIP effect similar to a conventional residual γ, but also it is also dispersed in old austenite grains when compared with the block-type residual γ existing mainly at the old austenite grain boundary, and thus the entire structure becomes uniform and deformation can arise to some extent. Therefore, generation of cracking during local deformation is suppressed, which leads to an improvement in stretch flangeability.

Since the lath-type residual γ has a large boundary area per volume with a matrix phase and also has a high hydrogen absorption ability, it also has the effect of suppressing delayed fracture derived from diffusible hydrogen. In addition, since the lath-type residual γ is stable when compared with the block-type residual γ and is remained in a certain amount after working and also the boundary surface with the matrix phase serves as a trap site of hydrogen after transformed into martensite, such characteristics also contribute to an improvement in anti-delayed fracture characteristics.

In order to effectively exert such an effect, the content of the lath-type residual γ must be 3% or more, and preferably 6% or more.

1%≦Block-Type Residual γ≦Lath-Type Residual γ Occupancy Ratio×½

"Block-type" as used herein means those in which an average axial ratio (major axis/minor axis) is less than 3. The residual γ has the effect of being transformed into martensite when the steel material is deformed by application of strain thereby promoting hardening of the deformed portion and preventing concentration of strain (TRIP effect).

Although the lath-type residual γ is stable to a high strain range when compared with the block-type residual γ, a high-strength steel sheet having a tensile strength of 980 MPa or higher class, which is likely to be fractured at comparatively low elongation, may be fractured before the TRIP effect is sufficiently exerted. In contrast, the block-type residual γ is likely to exert the TRIP effect at a low strain range. Therefore, it becomes possible to obtain excellent TRIP effect in a wide range from a low to high strain range by properly control a ratio of the content of the lath-type residual γ to that of the block-type residual γ.

In order to effectively exert such an effect, the occupancy ratio of the block-type residual γ of 1% must be ensured. However, when the occupancy ratio is more than ½ times (0.5 times) lager than that of the lath-type residual γ, the TRIP effect at the low strain range is mainly exerted and it becomes impossible to desire the effect of improving elongation. Furthermore, since the amount of the block-type residual γ, which is transformed into martensite at an initial stage of the subsequent deformation, increases, cracking is likely to occur from martensite as the starting point and also stretch flangeability deteriorates. Furthermore, since anti-delayed fracture characteristics deteriorate, the occupancy ratio must be 0.5 times smaller than that of the block-type residual γ.

Even if martensite is incorporated into the block-type residual γ, deterioration of characteristics is sufficiently suppressed when the relation of the occupancy ratio with the lath-type residual γ and the average grain size described below are satisfied. Therefore, there is no restriction on the amount of martensite to be inevitably incorporated.

Average Grain Size of Block-Type Residual γ≦10 μm

In order to effectively exert the effect of the block-type residual γ, the average grain size of the block-type residual γ must be 10 μm or less, including martensite, incorporation of which is permitted. When the average grain size of the block-type residual γ is more than 10 μm, cracking occurs at an initial stage, and thus not only stretch flangeability deteriorates, but also anti-delayed fraction property deteriorates. From such a point of view, the average grain size of the block-type residual γ is more preferably 5 μm or less. The average grain size of the block-type residual γ as used herein means an average of an equivalent circle diameter (diameter of a circle having the same area) of the block-type residual γ.

There is no noticeable restriction on the production conditions required to obtain the above metal structure defined in the present invention. In usual production procedures of a steel sheet, for example, continuous casting, hot rolling, pickling, cold rolling and continuous annealing, a heating temperature, a heating rate, a holding temperature, a cooling initiation temperature and a cooling rate maybe properly controlled. In the case of a galvanized steel sheet and a galvannealed steel sheet, proper temperature control including a continuous galvanizing line may be performed. Since heat treatment conditions in a continuous annealing line are most important so as to obtain the metal structure, preferred heat treatment conditions in the continuous annealing line will be mainly explained.

Heating Temperature Upon Annealing: $Ac_3$+10° C. or Higher

In order to obtain the bainitic ferrite-riched metal structure, the heating temperature upon annealing may be adjusted to "$Ac_3$+10° C. or higher" so as to suppress formation of polygonal ferrite. By the way, when continuous annealing performed at an $Ac_3$ point or lower, polygonal ferrite is likely to be formed in the subsequent cooling step since the residual ferrite serves as a nucleus, and thus it becomes difficult to obtain the intended metal structure in the present invention. Therefore, more preferred heating temperature is "$Ac_3$+30° C. or higher".

Cooling Rate after Annealing

The cooling rate after annealing is an important control matter so as to uniformly form polygonal ferrite. That is, when the cooling rate after annealing is too large, the content of polygonal ferrite decreases. In contrast, when the cooling rate is too small, the content of polygonal ferrite excessively increases and the grain size may increase. Therefore, the cooling rate after annealing may be preferably controlled within the range from 15 to 100° C./sec, and more preferably 20 to 70° C./sec.

It is also effective to obtain the target metal structure by cooling to about 550° C. or lower at which fine ferrite is likely to be formed at a high rate (for example, 20° C./sec or higher) and controlling the cooling rate at the temperature or lower within the range from about 10 to 20° C./sec, not cooling at a given rate.

Quenching Termination Temperature after Annealing

The temperature at which quenching after annealing is terminated should be controlled to the temperature at which the transformation other than the fine polygonal ferrite or bainitic ferrite transformation does not proceed (for example, about 340 to 460° C.). In the case of excess quenching, martensite is likely to be formed and it becomes difficult to obtain the intended metal structure.

Holding Temperature after Cooling

After cooling, since bainitic transformation proceeds by holding at a given temperature and also concentration of C to austenite proceeds to form residual γ, it is important to properly control the holding temperature after cooling. The holding temperature is preferably within the range from 360 to 440° C. so as to obtain the metal structure of the present invention. The retention time is preferably one minute or more. It is necessary that the holding temperature is higher than the quenching termination temperature.

As the annealing conditions for realizing the structure defined in the present invention, first, it is controlled to form a small amount of fine block-type residual γ by quickly cooling to a low temperature. When the composition defined in the present invention and a relation thereof are satisfied, a given amount or more of block-type residual γ is ensured. By controlling the holding temperature thereafter to the temperature higher than the cooling termination temperature, the bainitic ferrite transformation is promoted thereby controlling the amount of the lath-type residual γ and that of the block-type residual γ so as to satisfy a predetermined relation between them.

In the high-strength steel sheet of the present invention, a composite steel sheet having a high strength of 980 MPa or higher class, good elongation and stretch flangeability, and excellent spot-weldability and anti-delayed fraction property can be provided at cheap price by using a steel material having specified chemical components as described above and employing proper heat treatment conditions including cooling conditions and holding conditions thereby ensuring a predetermined metal structure.

EXAMPLES

The present invention is further illustrated by the following examples. It is to be understood that the present invention is not limited to the examples, and various design variations made in accordance with the purports described hereinbefore and hereinafter are also included in the technical scope of the present invention.

Test Example

Steel materials with compositions shown in Table 1 were prepared, subjected to continuous casting, subjected to hot rolling and cold rolling under the conditions described below and then subjected to a heat treatment (annealing) under the conditions shown in Table 2 to obtain cold rolled steel sheets.

[Hot Rolling]

Heating temperature: 1,200° C. for 60 minutes

Finish temperature: 880° C.

Cooling: Cooling to 720° C. at 40° C./sec, cooling for 10 seconds, cooling to 500° C. at 40° C./sec and holding at 500° C. for 60 minutes, followed by furnace cooling.

Finish thickness: 3.2 mm

[Pickling, Cold Rolling]

After pickling, cold rolling was performed to obtain a cold sheet having a thickness of 1.2 mm.

[Heat Treatment (Annealing)]

As shown in Table 2, each cold rolled sheet was heated to a predetermined annealing temperature, held at the same temperature for 180 seconds, cooled to a predetermined cooling termination temperature at a predetermined cooling rate, held at a predetermined temperature for 4 minutes and then furnace-cooled.

The metal structure of the resultant cold rolled steel sheet was confirmed by the following method and each test steel sheet was subjected to a tension test, a bore expansion test, a spot-welding test and an anti-delayed fracture test. The results collectively shown in Tables 2 and 3 were obtained.

[Metal Structure]

Structure Identification Method

A: Optical microscope observation (magnification: ×1,000) by repeller corrosion, 1 visual field B: SEM observation (magnification: ×4,000), 4 visual fields Polygonal Ferrite (PF)

The occupancy ratio is calculated from the micrograph taken by A described above. Polygonal ferrite is identified since etched residual γ and etched martensite show a white color, whereas, etched PF shows a gray color.

Lath-Type Residual γ and Block-Type Residual γ

After residual γ was confirmed by an electron backscattering pattern (may be referred to as EBSP), an area ratio was calculated from the micrograph taken by B described above. That is, the residual γ having an aspect ratio of 3 or less was extracted by image analysis of a SEM image and an average value of the equivalent circle diameter was determined. It was confirmed by EBSP whether or not it is residual γ.

Bainitic Ferrite (BF)

After confirming that the structure is not a structure of bainite or pseudo-ferrite by a transition electron microscope (TEM: magnification of ×15,000), the occupancy ratio was calculated by subtracting an amount of polygonal ferrite and an amount of the residual γ from 100%.

[Performance Evaluation Test]

Tension test: The measurement was performed using JIS No. 5 tension test specimens.

Bore expansion test: The test was performed in accordance with the Japan Iron and Steel Federation Standard (JFST) 1001.

Spot-Weldability:

Spot-welding was performed under the following conditions. The case where a ductility ratio at a nugget diameter of $5\sqrt{t}$ is 0.30 or more was rated Good (○).

<Welding Conditions>

Thickness of test material: 1.2 mm

Electrode: Dome radius type (tip diameter: 6 mm)

Pressure: 375 kg

Upslope: 1 cycle, electrification time: 12 cycles, hold: 1 cycle (60 Hz)

Adjustment of nugget: adjusted by welding current

Ductility ratio: Cross tensile strength/Shear tensile strength

[Anti-Delayed Fraction Property]

After performing V-shaped bending using a 60° V-block of R=3 mm, stress of 1,500 MPa was applied to the bent portion, followed by immersion in an aqueous 5% hydrochloric acid solution. Then, the time until cracking occurs was measured. The case where cracking did not occur after 24 hours was rated good anti-delayed fraction property (○).

TABLE 1

| Steel type | C | Si | Mn | P | S | Al | Others | Si/C | $Ac_3$ point | Remarks |
|---|---|---|---|---|---|---|---|---|---|---|
| | Steel components (% by mass) | | | | | | | | | |
| A | 0.17 | 1.5 | 2.1 | 0.01 | 0.002 | 0.035 | | 8.8 | 851 | |
| B | 0.23 | 1.8 | 2.3 | 0.005 | 0.002 | 0.035 | | 7.8 | 842 | |
| C | 0.17 | 2.3 | 2.0 | 0.005 | 0.002 | 0.035 | | 13.5 | 887 | |
| D | 0.17 | 2.3 | 2.6 | 0.005 | 0.002 | 0.035 | | 13.5 | 869 | |
| E | 0.14 | 1.5 | 2.2 | 0.005 | 0.002 | 0.035 | | 10.7 | 853 | |
| F | 0.17 | 1.2 | 2.5 | 0.005 | 0.002 | 0.035 | | 7.1 | 822 | |
| G | 0.17 | 1.8 | 2.1 | 0.005 | 0.002 | 0.035 | Cr: 0.5 | 10.6 | 856 | |
| H | 0.17 | 1.35 | 2.3 | 0.001 | 0.002 | 0.035 | Nb: 0.04 | 7.9 | 832 | |
| I | 0.17 | 1.8 | 2.3 | 0.001 | 0.002 | 0.035 | Ti: 0.05 | 10.6 | 852 | |
| J | 0.14 | 1.2 | 2.5 | 0.01 | 0.001 | 0.20 | | 8.6 | 900 | |
| K | 0.08 | 1.3 | 2.1 | 0.01 | 0.003 | 0.035 | | 16.3 | 855 | Comparative material |
| L | 0.22 | 0.5 | 2.8 | 0.01 | 0.003 | 0.035 | Cr: 0.05 | 2.3 | 755 | Comparative material |
| M | 0.17 | 1.8 | 1.2 | 0.01 | 0.003 | 0.035 | | 10.6 | 878 | Comparative material |
| N | 0.23 | 0.8 | 2.5 | 0.01 | 0.003 | 0.035 | | 3.5 | 780 | Comparative material |
| O | 0.17 | 1.35 | 2.25 | 0.01 | 0.003 | 0.035 | Ca: 15 ppm | 7.9 | 826 | |

TABLE 2

| Steel type | Heat treatment: Annealing (° C.) | Cooling rate (° C./min) | Cooling termination temperature (° C.) | Holding temperature (° C.) | Metal structure: PF (%) | Lath-type residual γ (%) | Block-type residual γ (%) | BF (%) | Ratio: lath-type residual γ/block-type residual γ | Size of block-type residual γ (μm) | Remarks |
|---|---|---|---|---|---|---|---|---|---|---|---|
| A | 900 | 50 | 360 | 380 | 16 | 12 | 4 | 67 | 3.0 | 3.1 | Invented steel |
| B | 880 | 50 | 380 | 400 | 6 | 15 | 5 | 75 | 3.0 | 3.4 | Invented steel |
| C | 930 | 100 | 380 | 390 | 6 | 12 | 4 | 78 | 3.0 | 2.2 | Invented steel |
| D | 910 | 50 | 400 | 400 | 5 | 13 | 3 | 79 | 4.3 | 6.2 | Invented steel |
| E | 900 | 50 | 380 | 390 | 22 | 8 | 3 | 67 | 2.7 | 5.9 | Invented steel |
| F | 890 | 50 | 380 | 390 | 7 | 9 | 3 | 82 | 3.0 | 7.0 | Invented steel |
| G | 900 | 50 | 360 | 400 | 13 | 10 | 4 | 73 | 2.5 | 4.1 | Invented steel |
| H | 900 | 50 | 380 | 400 | 11 | 10 | 3 | 76 | 3.3 | 4.9 | Invented steel |
| I | 900 | 50 | 380 | 400 | 9 | 11 | 4 | 76 | 2.8 | 3.5 | Invented steel |
| J | 950 | 50 | 380 | 390 | 20 | 10 | 4 | 66 | 2.5 | 8.9 | Invented steel |
| O | 900 | 50 | 380 | 380 | 15 | 14 | 4 | 67 | 3.5 | 4.0 | Invented steel |
| K | 900 | 100 | 380 | 380 | 30 | 3 | 15 | 52 | 0.2 | 8.7 | Comparative steel |
| L | 820 | 50 | 380 | 380 | 5 | 4 | 35 | 56 | 0.1 | 7.7 | Comparative steel |
| M | 890 | 50 | 380 | 380 | 50 | 6 | 8 | 36 | 0.8 | 15.7 | Comparative steel |
| N | 880 | 50 | 380 | 380 | 20 | 5 | 29 | 46 | 0.2 | 20.0 | Comparative steel |
| F | 815 | 20 | 380 | 380 | 30 | 10 | 25 | 35 | 0.4 | 8.3 | Comparative steel |
| B | 900 | 80 | 350 | 350 | 0 | 14 | 0 | 86 | — | — | Comparative steel |

TABLE 3

| Number | Steel type | Mechanical properties: YP (MPa) | TS (MPa) | EL (%) | λ (%) | YR (MPa) | TS × EL (MPa · %) | TS × λ (MPa · %) | Spot-weldability | Anti-delayed fraction property | Remarks |
|---|---|---|---|---|---|---|---|---|---|---|---|
| 1 | A | 650 | 985 | 19.0 | 63 | 0.66 | 18715 | 62432 | ○ | ○ | Invented material |
| 2 | B | 797 | 1092 | 18.3 | 64 | 0.73 | 20019 | 70010 | ○ | ○ | Invented material |
| 3 | C | 770 | 1040 | 16.3 | 73 | 0.74 | 16964 | 76432 | ○ | ○ | Invented material |
| 4 | D | 793 | 1220 | 19.2 | 51 | 0.65 | 23405 | 62418 | ○ | ○ | Invented material |
| 5 | E | 710 | 1014 | 15.8 | 64 | 0.70 | 16051 | 65020 | ○ | ○ | Invented material |
| 6 | F | 767 | 1080 | 17.2 | 62 | 0.71 | 18553 | 67400 | ○ | ○ | Invented material |
| 7 | G | 761 | 1170 | 16.1 | 57 | 0.65 | 18889 | 66512 | ○ | ○ | Invented material |
| 8 | H | 714 | 1035 | 15.1 | 66 | 0.69 | 15652 | 68000 | ○ | ○ | Invented material |
| 9 | I | 734 | 1080 | 16.9 | 57 | 0.68 | 18274 | 61200 | ○ | ○ | Invented material |
| 10 | J | 752 | 1074 | 17.0 | 64 | 0.70 | 18243 | 69044 | ○ | ○ | Invented material |
| 11 | O | 718 | 1040 | 17.0 | 66 | 0.69 | 17680 | 73230 | ○ | ○ | Invented material |
| 12 | K | 590 | 952 | 15.8 | 47 | 0.62 | 15021 | 44890 | ○ | ○ | Comparative material |
| 13 | L | 882 | 1260 | 16.0 | 39 | 0.70 | 20123 | 49703 | X | X | Comparative material |
| 14 | M | 450 | 750 | 31.0 | 38 | 0.60 | 23280 | 28705 | ○ | ○ | Comparative material |
| 15 | N | 610 | 1052 | 15.1 | 24 | 0.58 | 15897 | 25680 | X | X | Comparative material |
| 16 | F | 886 | 1150 | 13.5 | 39 | 0.77 | 15561 | 44500 | ○ | X | Comparative material |
| 17 | B | 1056 | 1320 | 10.6 | 46 | 0.80 | 13949 | 61359 | ○ | ○ | Comparative material |

The following facts become apparent from the results shown in Tables 1 to 3.

Numbers 1 to 12 are Examples which satisfy all defined features of the present invention. All steel materials show good results in all of mechanical properties including strength×elongation characteristics and strength×stretch flangeability, and also have good spot-weldability and anti-delayed fraction property.

In contrast, in Number 12, since the steel material has low C content and also has a ratio Si/C, which is not within a defined range, it contains excessive block-type residual γ and has very poor strength×elongation characteristics and strength×stretch flangeability characteristics. In Number 13, since the steel material has low Si content and a ratio Si/C, which is not within a defined range, it contains excessive block-type residual γ and has very poor strength×stretch flangeability characteristics and also has poor spot-weldability and anti-delayed fraction property.

In Number 14, since the steel material has low Mn content, the steel material has not sufficient strength and cannot satisfy a strength level of 980 MPa class. In Number 15, although the absolute contents of C and Si satisfy a defined value, a ratio Si/C is not within a defined feature and also the content of block-type residual γ and the size are large, and thus the steel material has poor strength×elongation characteristics and also has very poor spot-weldability and anti-delayed fraction property. In Number 16, although the steel composition is proper, the cooling rate upon a heat treatment is improper and the content of block-type residual γ is large, and thus the steel material has poor strength×elongation characteristics and strength×stretch flangeability, and also has very poor anti-delayed fraction property. In Number 17, since balance between the cooling rate upon a heat treatment, the cooling termination temperature and the holing temperature is poor and any block-type residual γ is not formed, the steel material has low elongation and also has very poor strength×elongation characteristics.

The invention claimed is:

1. A high-strength steel sheet having excellent elongation, stretch flangeability and weldability, comprising a steel containing the following elements in % by mass:

C: 0.10 to 0.25%,
Si: 1.0 to 3.0%,
Mn: 1.5 to 3.0%,
P: 0.15% or less,
S: 0.02% or less,
Al: 0.4% or less, and comprising the remnant made from iron and unavoidable impurities, wherein a ratio of the contents of Si and C (Si/C) is within the range from 7 to 14 in terms of a mass ratio, an $Ac_3$ point is from 822° C. to 900° C., and a microstructure in a longitudinal section comprises, by an occupancy ratio based on the entire structure,
1) bainitic ferrite: 50% or more,
2) lath-type residual austenite: 3% or more, and
3) block-type residual austenite: 1% or more to ½×occupancy ratio of lath-type residual austenite, and
4) average size of block-type residual austenite is 10 μm or less.

2. The high-strength steel sheet according to claim 1, wherein the steel further contains, as other elements, at least one kind selected from the group consisting of:

Ti: 0.15% or less,
Nb: 0.1% or less, and
Cr: 1.0% or less.

3. The high-strength steel sheet according to claim 1, wherein the steel further contains an element selected from the group consisting of Ca: 30 ppm or less, REM: 30 ppm or less and mixtures thereof.

4. The high-strength steel sheet according to claim 1, which has a tensile strength of 980 MPa or higher.

5. The high-strength steel sheet according to claim 2, wherein the steel further contains an element selected from the group consisting of Ca: 30 ppm or less, REM: 30 ppm or less and mixtures thereof.

6. The high-strength steel sheet according to claim 2, which has a tensile strength of 980 MPa or higher.

7. A high-strength steel sheet having excellent elongation, stretch flangeability and weldability, comprising a steel containing the following elements in % by mass:

C: 0.10 to 0.25%,
Si: 1.0 to 3.0%,
Mn: 2.0 to 3.0%,
P: 0.15% or less,
S: 0.02% or less,
Al: 0.4% or less, and comprising the remnant made from iron and unavoidable impurities, wherein a ratio of the contents of Si and C (Si/C) is within the range from 7 to 14 in terms of a mass ratio and a microstructure in a longitudinal section comprises, by an occupancy ratio based on the entire structure,
1) bainitic ferrite: 50% or more,
2) lath-type residual austenite: 3% or more, and
3) block-type residual austenite: 1% or more to ½×occupancy ratio of lath-type residual austenite, and
4) average size of block-type residual austenite is 10 μm or less.

8. The high-strength steel sheet according to claim 7, wherein the steel further contains, as other elements, at least one kind selected from the group consisting of:

Ti: 0.15% or less,
Nb: 0.1% or less, and
Cr: 1.0% or less.

9. The high-strength steel sheet according to claim 7, wherein the steel further contains an element selected from the group consisting of Ca: 30 ppm or less, REM: 30 ppm or less and mixtures thereof.

10. The high-strength steel sheet according to claim 7, which has a tensile strength of 980 MPa or higher.

11. The high-strength steel sheet according to claim 8, wherein the steel further contains an element selected from the group consisting of Ca: 30 ppm or less, REM: 30 ppm or less and mixtures thereof.

12. The high-strength steel sheet according to claim 8, which has a tensile strength of 980 MPa or higher.

13. The high-strength steel sheet according to claim 7, wherein the $Ac_3$ point of the steel is from 822° C. to 900° C.

* * * * *